US007013969B1

(12) United States Patent
Loudermilk

(10) Patent No.: US 7,013,969 B1
(45) Date of Patent: Mar. 21, 2006

(54) LOW NOISE LEVEL HVAC SYSTEM HAVING DISPLACEMENT WITH INDUCTION

(76) Inventor: Kenneth J. Loudermilk, 385 Falling Creek Bend, Duluth, GA (US) 30097

( * ) Notice: Subject to any disclaimer, the term of this patent is extended or adjusted under 35 U.S.C. 154(b) by 0 days.

(21) Appl. No.: 10/886,738

(22) Filed: Jul. 9, 2004

(51) Int. Cl.
*F24F 11/04* (2006.01)

(52) U.S. Cl. ..... 165/248; 454/262; 454/263

(58) Field of Classification Search ..... 454/261–263, 454/269; 165/248–251
See application file for complete search history.

(56) References Cited

U.S. PATENT DOCUMENTS 2,976,794 A * 3/1961 Claes et al. ..... 454/263
3,263,743 A * 8/1966 Baumgarten ..... 165/300
3,422,888 A * 1/1969 Traver et al. ..... 165/123
3,528,614 A * 9/1970 Honmann ..... 239/602
3,611,908 A * 10/1971 Spoormaker ..... 454/264
3,946,647 A * 3/1976 Larkfeldt ..... 454/263
3,951,205 A * 4/1976 Zilbermann ..... 165/214
4,281,592 A * 8/1981 Maxson et al. ..... 454/266
4,328,926 A * 5/1982 Hall, Jr. ..... 236/13
5,516,330 A * 5/1996 Dechow et al. ..... 454/74

* cited by examiner

*Primary Examiner*—William E. Tapolcai
(74) *Attorney, Agent, or Firm*—William B. Noll

(57) ABSTRACT

A displacement ventilation, low noise level, mixed air, HVAC system for ventilating a commercial or educational facility. The system includes a central HVAC air handling unit containing first and second duct works for receiving and transmitting conditioned air to rooms of the facility. Additionally, the system includes at least one air displacement terminal housing for delivering conditioned air to the room, where the air is delivered through an outlet in proximity to the floor of the room in a displacement manner.

7 Claims, 3 Drawing Sheets

LOW NOISE LEVEL HVAC SYSTEM HAVING DISPLACEMENT WITH INDUCTION

FIELD OF THE INVENTION

This invention is directed to the field of heating, ventilating, and air conditioning (HVAC) systems, but more especially to a low noise level system having displacement with induction, where the system hereof has particular utility in serving educational facilities, such as classrooms, where unneeded noise can be disruptive to an effective teaching environment.

BACKGROUND OF THE INVENTION

The present invention relates to an HVAC system having displacement with induction that meets or exceeds accepted standards for acoustical levels, especially for educational facilities. Designers of such a system face considerable challenges in applying equipment that complies with the acoustical levels specified in ANSI/ASA Standard S12.60, adopted in 2002. Like all ANSI Standards, the imposition of S12.60 is voluntary, so its evolution as a regulatory document is likely to be a gradual process. Notwithstanding such evolution, the instant invention is prepared to meet the challenges.

ANSI/ASA Standard S12-60-2002 developed as a result of engineers seeking to reduce noise levels in the nation's classrooms. Its objective was to ensure that the educator's speech could be clearly understood by almost all of the students within the classroom, when delivered at levels that do not require electronic amplification nor cause undue vocal stress on the educator. The introduction of the Standard in 2002 was made amid a great deal of industry controversy as it stipulated the maintenance of space noise levels not exceeding 35 dBA (about NC27) in core learning areas. Conformance to the Standard essentially precludes the use of unit ventilators and other packaged equipment within the classroom as sufficient insulation and/or isolation of these noise sources cannot feasibly be accomplished. Fan coils and heat pumps serving the classroom would also have to be located outside the space and ducted to allow for an appropriate level of attenuation prior to discharge within the space. It should be noted that the 2003 ASHRAE Handbook (Applications) recommends that classrooms be designed for acoustical levels conforming to the Standard.

Almost all North American schools are served by mixed air diffusion systems. Mixed systems, though operating in a cooling mode, introduce conditioned air at discharge velocities of 250 to 300 fpm, (1.25 to 1.5 m's) and supply air temperatures as low as 55 degree F. They rely on relatively high discharge velocities to entrain room air and mix it thoroughly with the supply air near the point of discharge. Residual air movement caused by this induction creates well mixed conditions and uniform temperature and contamination levels throughout the space. This contaminant removal method is referred to as dilution ventilation. It should be noted that the ideal upper limit of ventilation effectiveness in a mixed system is 1.0. Space temperature control may be accomplished by a) varying the delivered air volume at a constant supply temperature, b) varying the supply air temperature at a constant air volume, or c) varying both the supply air volume and temperature.

Varying the supply air volume makes it almost impossible to maintain mandated outside airflow rates. To keep the air volume constant often results in increased energy usage at these constant air volume deliveries (typically 2.5 to 3 times the space minimum ventilation rate), and must be maintained at all times, regardless of load. Variations in space airflow rates also result in proportional variations in space RH during humid operational periods.

Displacement air conditioning has been considered in Europe as a method of providing high levels of comfort and ventilation effectiveness. It relies on natural stratification to transport conditioned air through the space. Cool air at 63 to 68 degree F. is supplied at very low discharge velocities (50 to 70 fpm) from low sidewall or floor based outlets. The low velocity is not sufficient to create significant entrainment of room air, thus the supply air maintains most of its thermal integrity as it falls and spreads across the floor. This air is confined to the lower extremities of the space by the warmer ambient air above it.

Occupants and electrical equipment in the classroom transfer heat to the ambient air by natural convection. This convective transfer (in the absence of random velocity vectors) results in the formation of thermal plumes along the boundaries of the heat sources which rise through the upper parts of the space (gradually increasing in volume as they rise) until they either encounter equally warm air or reach the overhead return outlet. Cool air from the floor, drawn upward as the plume forms, passes over the boundaries of the heat source, conditioning it and, in the case of the space occupants, providing the source of inhaled respiration. Exhaled air is warmer than ambient and is thus conveyed with the rising thermal plume directly to the upper portion of the space where it can be easily removed. No horizontal transport of the respiratory contaminants occurs in such a system. It is estimated that some 60% of the transmission of contagious disease in elementary schools is due to such airborne transmission.

Since an inductive air distributing system is a relatively new development, there is little prior art to help describe and understand how the system may be effective as an air handling system. One such U.S. patent is U.S. Pat. No. 6,569,010, to Miller et al., which teaches an air handling system that receives air from a primary air source and distributes that air in a room defining an enclosed space. The system is mounted in the ceiling of the room and generally comprises first, second, third, and fourth inductor units interconnected downstream to the primary air supply and which define first, second, third, and fourth areas, respectively, wherein the induced air flows through each of the inductor units, through a series of converging nozzles, and into each units, first, second, third, and fourth areas, respectively, and an air diffusing mechanism positioned adjacent to the first, second, third, and fourth areas which directs the induced air in first, second, third, and fourth directions, respectively. The inductors are generally arranged in a square configuration with the diffuser extending in the square space bound thereby.

Another prior system is described in U.S. Pat. No. 6,290,595, to Daunay, where the patent relates to a device for regulating the temperature of premises by a secondary air flow blown therein, and an upstream duct communicating with elements for supplying pressurized air, ending in a converging element emerging into a downstream duct communicating with the premises. The device is characterized in that a substantially rotating solid, capable of being positioned along the convergent element longitudinal axis, is arranged at least partially upstream of the outlet thereof, so as to define between the substantially rotating solid outer surface and the convergent element inner wall with a ring-shaped channel the size of which depends on the position of the solid relative to the wall.

Though the prior art is limited, it is acknowledged that displacement ventilation and/or conditioning for central type ventilation systems is known and used. Further, room air induction has been practiced in ventilating systems, particularly in Europe, but no system is known in the prior art that effectively combines these approaches in a low noise level, HVAC system in the manner of the present invention. The effectiveness of this combination will become more apparent in the following specification, especially when read in conjunction with the accompanying drawings.

SUMMARY OF THE INVENTION

This invention relates to a low noise level, mixed air, HVAC system that combines the technologies of room air induction with low velocity displacement air discharge to the desired space. Specifically, the system provides for the ventilation of an enclosed room of a commercial or educational facility. The system hereof has particular utility as a heating and cooling ventilation system for classrooms of an educational facility where excessive noise can be a disturbing distraction for a good educational environment. That is, the noise level from the system does not exceed about 35 dBA. The system comprises a central HVAC unit within the facility remote from the room, such as a classroom where the unit includes first duct work for transmitting conditioned air from the unit to the room, and second duct work for receiving and transmitting return air from the room to the unit. Means are provided for optionally mixing fresh air from the exterior of the facility with a portion of the return air. Finally, the unit further includes means to control the temperature of the conditioned air to be transmitted to the room. Cooperating therewith is a terminal housing in the room in communication with the first duct works and a complementary outlet for the first duct works. The terminal housing further includes high velocity nozzles with the conditioned air from the first duct work being forced there through to create mechanical energy to induce ambient air flow in the room. Also, an intake outlet is provided for transmitting induced air from the room, where the induced air mixes with the conditioned air passing through the high velocity nozzles. Further, the mixed air is delivered through a second outlet into the room in a displacement manner at a velocity no greater than 100 fpm. Additionally, a heat transfer coil, i.e. for heating or cooling, is provided in communication to the intake outlet to control the temperature of the induced air through the intake outlet prior to the air mixing. The heat transfer coil, when operating in a cooling mode, includes a continuous chilled water supply that is maintained at a temperature of at least one degree above the dew point of the room to prevent condensation within the terminal housing.

Accordingly, a feature of this invention is the provision of a low noise level, HVAC system for a commercial or educational facility that combines the principles of displacement ventilation and/or conditioning with room air induction.

Another feature hereof is the provision of a displacement terminal operating to discharge conditioned air to a facility room, such as a classroom, in proximity to the classroom floor to effect a displacement like air flow of conditioned air within the classroom.

A further feature of the invention lies in the maintenance of a continuous chilled water supply of a sufficient temperature to eliminate condensation within the terminal housing.

These and other features of the invention will become clearer from the following description and supporting drawings.

DETAILED DESCRIPTION OF PREFERRED EMBODIMENT

Figure 1:
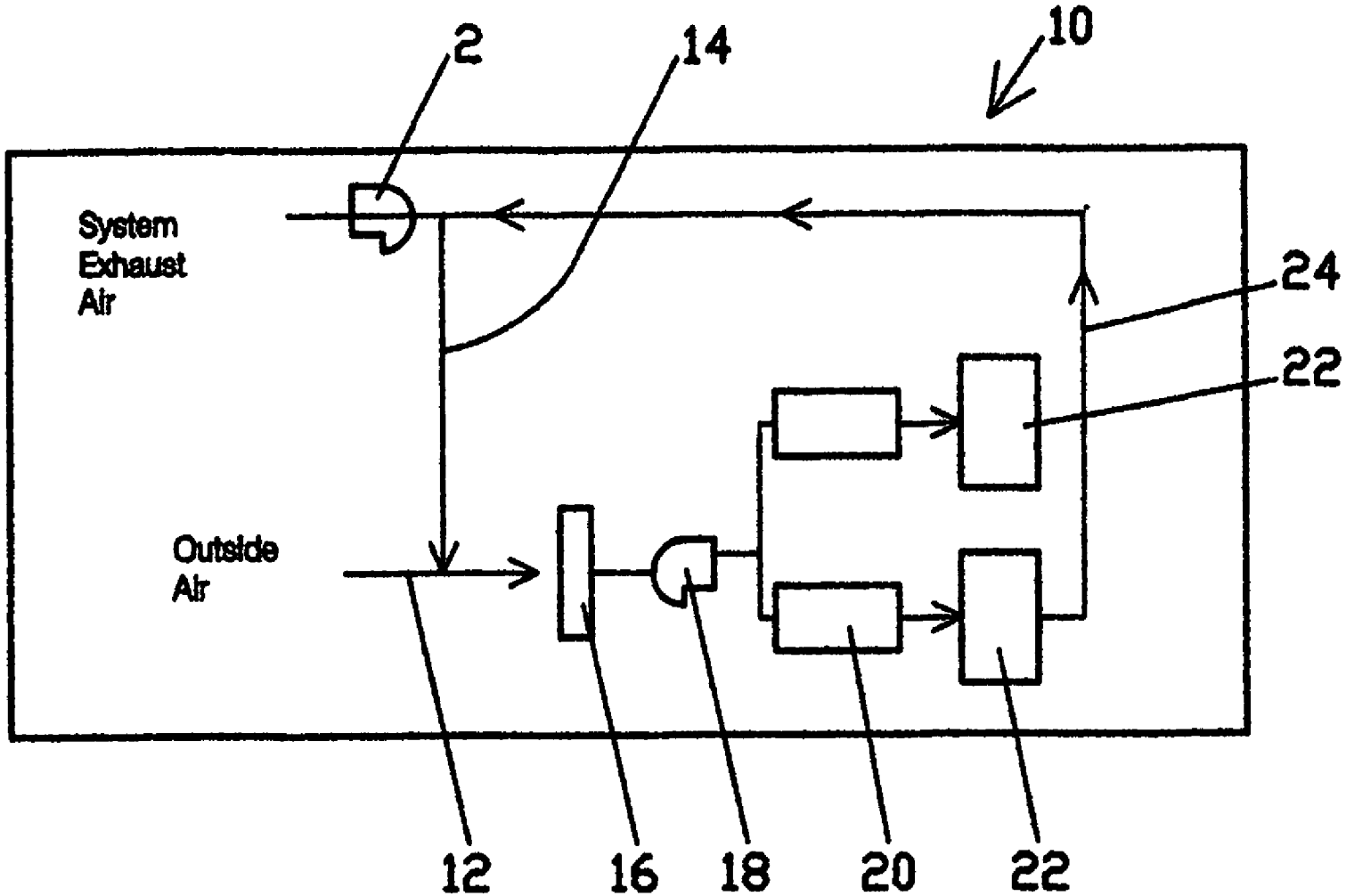
FIG. 1 is a simplified schematic diagram illustrating the HVAC ventilation system having displacement with induction, according to the present invention.

The instant invention is directed to a low noise level, HVAC system that combines the principles of displacement ventilation and/or conditioning with room air induction. The system will now be described with regard to the several Figures, where like reference numerals represent like components or features throughout the several views.

FIG. 1 is a simplified schematic diagram illustrating the air flow for the system 10 of this invention. Fresh or outside air is brought into the system via a conduit 12, where it optionally may be joined in part by recycled air via conduit 14. The mixed or fresh air is then chilled by a cooling coil 16, and blown by fans 18 into one or more room diffusers 20, where the diffusers control the amount of air sent to each room 22. Air returned from the one or more rooms moves via conduit 24 to be exhausted to the outside, or in part returned to the system.

Figure 2:
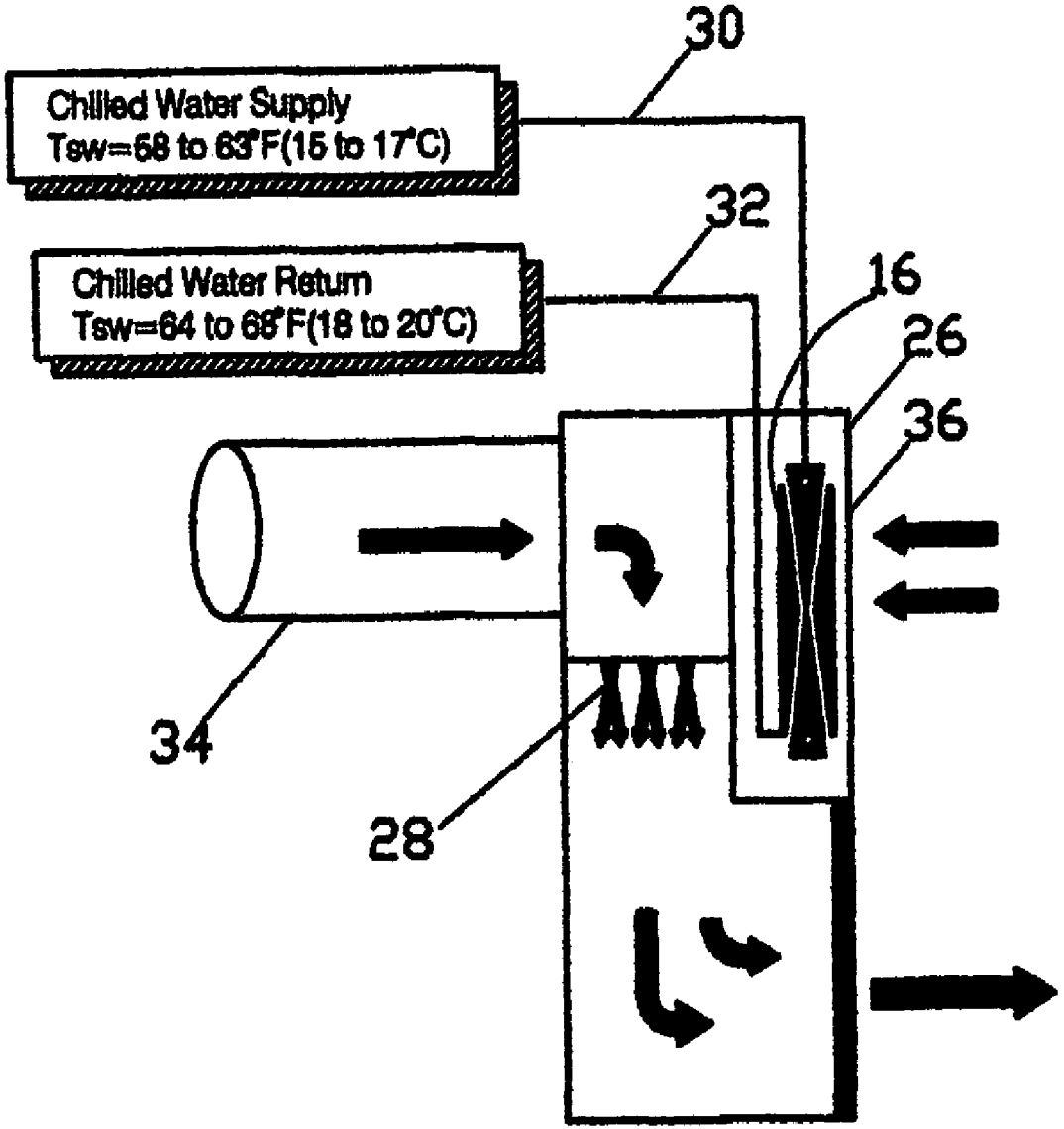
FIG. 2 is a sectional view of a terminal housing configuration for displacement with induction of the invention.

FIG. 2 illustrates a displacement terminal with induction incorporating components of FIG. 1. Specifically, FIG. 2 shows a terminal housing 26 that includes plural high velocity nozzles 28, as known in the art, and the cooling coil, preferably a hydronic sensible cooling coil. A continuous supply of chilled water is supplied to the cooling coil 16 via conduits 30, 32, where the supply water is maintained at least about 1 degree F. above the room dew point to avoid any condensation from forming during normal operation of the system. Though not shown, primary, preferably 100% outside, air is cooled and dehumidified at a central air handling unit remote from the room, i.e. classroom, then ducted to the terminal housing through the inlet 34. This air is then injected through the high velocity nozzles 28 to induce the room air.

In a typical educational facility, having a multiplicity of classrooms and administrative rooms, only a single central air handling unit is required. However, for each classroom, depending on size, there may be typically from three to five terminal housings, preferably located under a window such that the outgoing conditioned air is directed along and in proximity to the floor.

Concurrently, room air is induced through a grille work 36 in the terminal housing through the cooling coil 16 and mixed and conditioned with the primary air at an induction ratio of about 2 parts room air per one part of primary air, then into the room. This produces a constant volume discharge mixture at a temperature that can vary 6 to 8 degrees F. In most applications, space sensible cooling loads can be satisfied using a primary airflow rate equal to or very near the mandated space ventilation rate. In most extreme cases, the primary air flow rate may exceed the ventilation rate by 40 to 50%, although this airflow is still only about 40% of that required by a mixed system handling the same cooling load.

Figure 3:
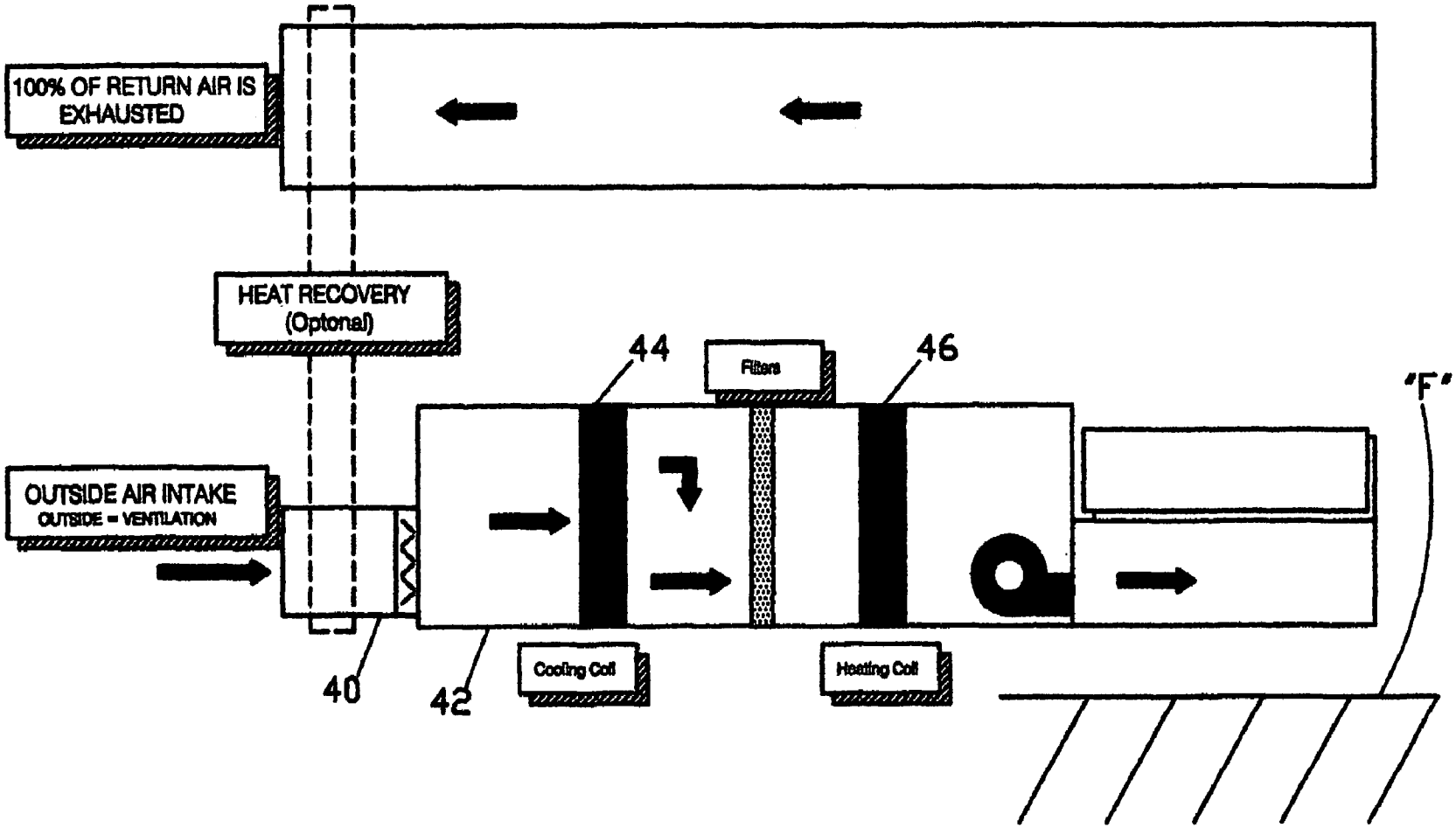
FIG. 3 is a typical air handler configuration for displacement with induction according to the system hereof.

FIG. 3 is a preferred air handling unit using 100% outside air. The employment of 100% outside air supply through conduit 40, without recirculation, greatly simplifies the air handling unit 42 design as no controls and/or dampers are required to accomplish economizer strategies. In fact, the plant can be a simple packaged unit with DX or hydronic cooling 44, dehumidification, and heating 46 capabilities, sized for less than the capacity required by a mixed system handling the same space loads. Chilled water for the sensible cooling coils can either be obtained from the return side of the air handling unit 42 or by use of a separate dedicated chiller.

As best seen in FIG. 3, the outgoing conditioned air is transmitted through the terminal housing unit along or in proximity to the floor "F". The units are mounted conveniently along the exposed perimeter wall of the room, such as under the windows, and fed by ductwork from the central air handling unit. Access to the terminal housings is provided through the cabinet face for changing filters and performing any other necessary maintenance. While maintaining delivery of the proper quantity of fresh conditioned air is of utmost importance, it is also prudent to assure that a certain portion of the air is distributed across the classroom floor at all times if the benefits of a displacement ventilation strategy are to be maintained. That is, a large quantity of conditioned air is directed toward the classroom occupants in a displacement manner, even if the space thermostat is calling for heat.

Displacement ventilation, as taught herein, improves the quality of the air in the classroom in several ways. First of all, its introduction within the occupied zone assures that all of the ventilation air is delivered to the occupants, i.e. pupils. In contrast, mixed systems that utilize ceiling diffusers approach a ventilation effectiveness of 100% only when they are properly selected and are operating at their design airflow. This effectiveness can be reduced to as low as 40% when the outlets are delivering reduced or warm air quantities as the supply air jet does not create entrainment sufficient to sustain mixing at the lower levels of the space. The effectiveness of displacement ventilation systems, such as taught herein, can easily exceed 100%.

The effectiveness of this combined system of displacement ventilation and/or conditioning, with room induction, can be appreciated through reduced construction costs or even retrofitting existing structures. For example, the transport of reduced primary air volumes allows the employment of significantly smaller supply duct work. Further, displacement with induction provides designers a proven and efficient method of affecting optimal removal of respiratory contaminants from a classroom, for instance, while maintaining acoustical levels conforming to ANSI/ASA Standard S12.60, to thereby provide a better learning environment for schools.

It is recognized that changes, variations and modifications may be made to displacement ventilation and/or conditioning system, especially by those skilled in the art, without departing from the spirit and scope thereof. Accordingly, no limitation is intended to be imposed on the invention except as set forth in the accompanying claims.

I claim:

1. A displacement ventilation, low noise level, mixed air, HVAC system for ventilating an enclosed room of a commercial or educational facility, where the system provides displacement ventilating air to said room at noise levels not exceeding about 35dBA, said system comprising:

a.) a central HVAC air handling unit within said facility remote from said room, said unit including first duct work for transmitting conditioned air from said unit to said room, second duct work for receiving and transmitting return air from said room to said unit, means for mixing fresh air from the exterior of said facility with a portion of said return air, where said unit further includes means to control the temperature of the conditioned air to be transmitted to said room; and, b.) an air displacement terminal housing in proximity to said room in communication with said first duct work, a complementary outlet for said first duct work, said terminal housing further including high velocity nozzles with the conditioned air from said first duct work forced there through to create mechanical energy to induce ambient air flow, an intake outlet for transmitting induced air from said room, where said induced air mixes with said conditioned air passing through said high velocity nozzles, said mixed air being delivered through a second outlet into said room in a displacement manner.

2. The displacement ventilation, low noise level, mixed air, HVAC system according to claim 1, including a heat transfer coil in communication to said intake outlet to control the temperature of the induced air through said intake outlet prior to said mixing.

3. The displacement ventilation, low noise level, mixed air, HVAC system according to claim 2, wherein the velocity of the mixed air through said second outlet is no greater than 100 fpm.

4. The displacement ventilation, low noise level, mixed air, HVAC system according to claim 2, wherein said heat transfer coil may be operated in heating and cooling modes.

5. The displacement ventilation, low noise level, mixed air, HVAC system according to claim 4, wherein said heat transfer coil, when operating in a cooling mode, includes a continuous chilled water supply, where said water supply is maintained at a temperature of at least one degree above the dew point of said room to prevent any condensation within said unit.

6. The displacement ventilation, low noise level, mixed air, HVAC system according to claim 1, wherein said room includes a floor and a ceiling, and said second outlet is located near said floor to induce an ambient air flow into said room.

7. The displacement ventilation, low noise level, mixed air, HVAC system according to claim 6, wherein said room further includes a perimeter wall, and said air displacement terminal housing is located within said wall.

* * * * *